US006215062B1

(12) United States Patent
Kimber

(10) Patent No.: US 6,215,062 B1
(45) Date of Patent: Apr. 10, 2001

(54) MULTI-CONDUCTOR BRAIDED CABLE

(76) Inventor: Ray Latham Kimber, 2752 S. 1900 West, Ogden, UT (US) 84401

( * ) Notice: Subject to any disclaimer, the term of this patent is extended or adjusted under 35 U.S.C. 154(b) by 0 days.

(21) Appl. No.: 09/274,654

(22) Filed: Mar. 23, 1999

(51) Int. Cl.[7] ..... H01B 11/00
(52) U.S. Cl. ..... 174/27; 174/113 R
(58) Field of Search ..... 174/113 R, 36, 174/114 R, 27, 26 R

(56) References Cited

U.S. PATENT DOCUMENTS

| | | | | |
|---|---|---|---|---|
| 4,150,249 | * | 4/1979 | Pedersen | 174/36 |
| 4,372,105 | * | 2/1983 | Ellis, Jr. | 57/204 |
| 4,734,696 | * | 3/1988 | Rogers | 340/825 |
| 4,764,939 | * | 8/1988 | Rogers | 375/37 |
| 4,767,890 | | 8/1988 | Magnan . | |
| 4,837,405 | * | 6/1989 | Bonjour et al. | 174/36 |
| 4,910,360 | | 3/1990 | Lee . | |
| 5,266,744 | * | 11/1993 | Fitzmaurice | 174/103 |
| 5,298,680 | * | 3/1994 | Kenny | 174/36 |
| 5,298,682 | | 3/1994 | Salz . | |
| 5,376,758 | | 12/1994 | Kimber . | |
| 5,503,155 | * | 4/1996 | Salmon et al. | 128/662.06 |
| 5,523,528 | * | 6/1996 | Bese et al. | 174/36 |
| 5,821,466 | * | 10/1998 | Clark et al. | 174/113 R |
| 5,831,210 | | 11/1998 | Nugent . | |
| 5,888,100 | * | 3/1999 | Bofill et al. | 439/676 |
| 6,017,237 | * | 1/2000 | Sullivan | 439/392 |
| 6,066,799 | * | 5/2000 | Nugent | 174/27 |

* cited by examiner

*Primary Examiner*—Kristine Kincaid
*Assistant Examiner*—William H Mayo, III
(74) *Attorney, Agent, or Firm*—Working Nydegger Seeley

(57) ABSTRACT

A cable assembly having of a first pair of conductors and a second pair of conductors is presented that provides high common mode rejection. The cable assembly may be implemented in either a single channel configuration where two of the four wires are electrically connected with the positive terminal while the remaining two conductors are inner connected with the negative terminal. A dual channel configuration is also presented and provides high common mode rejection due to the orthogonal nature of the braiding pattern of the individual conductors.

5 Claims, 2 Drawing Sheets

MULTI-CONDUCTOR BRAIDED CABLE

BACKGROUND OF THE INVENTION

1. The Field of the Invention

This invention relates to the field of communication cable technology. More specifically, this invention relates to a cable made of wire pairs. Additionally and more specific, this invention relates to a communication cable for facilitating propagation of high frequency signals with minimal interference to adjacent signals within a multiconductor cable.

2. Relevant Technology

Traditional interface cables have heretofore assumed a largely parallel environment which also heretofore has provided adequate signal propagation for traditional audio frequencies. However, with the advent of high fidelity audio equipment in addition to the ubiquitous nature of high frequency and even high bandwidth computer and other communication devices, a largely planar and parallel orientation of interconnection wires has proven inadequate as the rise times, and hence the frequencies associated therewith, have increased to levels which induce the propagation of signals that can and do provoke distortion and interference into adjacent conductors.

One interim attempt at remedying such cross-talk has been to employ a cable having a center conductor with a dielectrically-interspersed sheathed shielded conductor. Such cabling attempts have commonly become known as coaxial cable (hereinafter "coax" cable). Standard coax cable has heretofore been used for sensitive-signal connections ranging from audio frequencies to several megahertz signals. However, as alluded to hereinabove, with the advent of higher frequency intercommunications, the increased rise times as well as the augmented bandwidth capabilities, now extending into the gigahertz frequencies, previous cable designs have been rendered inferior, inadequate and even obsolete. Those skilled in the art of cabling technology appreciate that coax cabling has at least two major inherent defects that become more pronounced at high frequencies and faster digital signal rise times.

First, typical coax cabling incorporates an outside conductor to shield the inner conducting lead using what may be thought of as a "Faraday Shield" for protecting the inner conductor from any outside signal interference. However, while the outer conductor shields the inner conductor from exterior extraneous signals, the inner conductor radiates its preferred signal into the shield or outside conductor which mixes with the outside-induced signals. Such a mixing or combining has heretofore been overlooked or ignored since they were previously considered only tolerable at their then present levels. One of the particularly overlooked facts has been that such signals cause random currents to be set up in the outside "shield" conductor which causes, over the length of the cable, a more predominant direct current (DC) voltage offset. Such a DC offset causes a DC shift in the timing edge of digital circuits since the signals induced in the outside conductor are alternating in response to the preferred signal projections from the inner conductor as well as the ambient signal levels exterior to the cable assembly, they tend to cause the DC offset voltage to vary with the induced noises and the primary signal.

A second shortcoming with a coax cabling system is that a coax system is not a balanced cabling system and coax only has a very limited frequency range where the $Z_0$ impedance is consistent with the rated impedance. Therefore, out-of-cable-specification signals cause an imbalance which causes reflected energy to be set up thereby requiring some form of electrical correction to subdue the reflected energies.

Thus, what is needed is a cable assembly capable of operating over a broad frequency range without incurring the shortcomings of the prior implementations.

SUMMARY AND OBJECTS OF THE INVENTION

It is therefore an object of the present invention to provide an improved transmission cable capable of minimizing cross talk.

It is another object of the present invention to provide a cable assembly capable of more efficiently propagating higher frequency signals without inducing interference on adjacent conductors.

The present invention relates to an arrangement of conductors in a cable assembly which eliminates the aforementioned deficiencies while permitting the transmission of high frequency signals which may additionally be conveyed at high power levels.

In the present invention, multiple strands of conductors are uniquely braided in a novel manner to provide improved performance to the cable assembly of the present invention. The unique braiding characteristics of the present invention provide for an inherently high common mode rejection since the signals are in an electrical and physical perpendicular configuration. Such an arrangement ignores or minimizes outside noise since the conductors are less sensitive to radiating fields due to a "ground plane" which is woven into the cable thereby causing the cable to operate as a balanced system.

The cable technique of the present invention can be employed for connecting various driving components to various receiving components such as the interconnection of audio drivers with audio transducers such as acoustic speakers. Additional applications may include communication cabling requiring high common mode rejection such as in the implementation of differential driver architectures, among others.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through he use of the accompanying drawings in which.

DETAILED DESCRIPTION OF THE PREFERRED EMBODIMENTS

A cable assembly for incorporating multiple conductors for use in communicating one or more groups of signals is presented. The present implementation utilizes the concept of balanced-systems for providing consistent propagation paths between the positive and negative signal conductors. The present invention also incorporates inherent shielding by utilizing common mode rejection principles inherent in differential signaling.

Figure 1A:
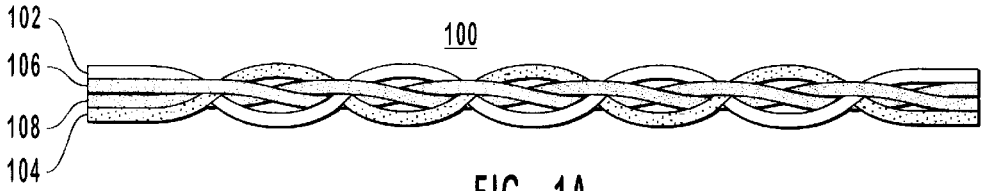
FIGS. 1A and 1B illustrate the geometry associated with the braiding of the conductors of the cable, in accordance with a preferred embodiment of the present invention.
Figure 1B:
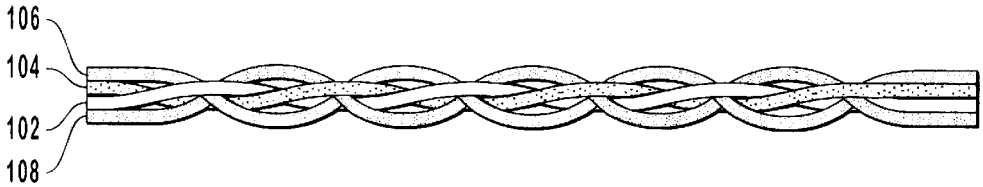

FIG. 1A and 1B depict the geometry associated with the braiding of the conductors in the cable, in accordance with a preferred embodiment of the present invention. FIG. 1A and 1B depict the same braiding architecture, however, FIG. 1B depicts a 90° rotational aspect of the cabling assembly depicted in FIG. 1A. It should be noted from FIGS. 1A and 1B that the preferred embodiment of the present cable assembly is comprised of four individual conductors. In FIG. 1A, cable assembly 100 is comprised of two individual pairs of conductors, a first conductor 102 and a second conductor 104, and a second pair of conductors comprised of a third conductor 106 and a fourth conductor 108.

It should be apparent from FIGS. 1A and 1B that the first pair of conductors, conductor 102 and conductor 104, create a generally planar twisted pair with the conductor pair being rotated counter-clockwise moving from left to right in FIGS. 1A and 1B which creates a series of apertures or spaces between the conductors between the portion of the pair of conductors that overlap. In the preferred embodiment, the size of the aperture formed by the twisting of the individual conductors associated with a pair is approximately sufficiently large to receive a pair of conductors passing side by side through the aperture in a plane generally perpendicular to the plane of the aperture.

FIGS. 1A and 1B also depict the second pair of conductors, a third conductor 106 and a fourth conductor 108, which when viewed in the rotational aspect of FIG. 1B also form a generally planar twisted pair also creating apertures with each 180° rotation of the wire pairs. However, the rotational direction of the twisted cable combination for the second connector pair comprised of a third conductor 106 and a fourth conductor 108 assumes a clockwise rotational scheme when viewed in FIGS 1A and 1B from left to right. Also apparent in FIG. 1B is the interwoven aspect of the first pair of conductors opposingly passing through the apertures created in the generally planar twisted pair combination of conductors 106 and 108.

It should be apparent that each of the conductors in the first pair and second pair of conductors is comprised of an approximately equal length of conductors, thereby better matching the propagation delays as well as the resistance of each of the conductors. Such a matching enhances the timing and propagation of signals therethrough. The cable assembly of the present invention therefore finds favorable application for connecting a broad range of components passing a broad spectrum of signals. Such applications include the connection of audio equipment such as an audio amplifier with a remote transducer or speaker for the conveyance of audio frequencies therebetween. Yet another application favorable for the cable assembly of the present invention includes transmission of higher speed data such as computer and other data which are more favorably transceived via a balanced cable network that may employ the benefits associated with common mode rejection techniques.

Figure 2:
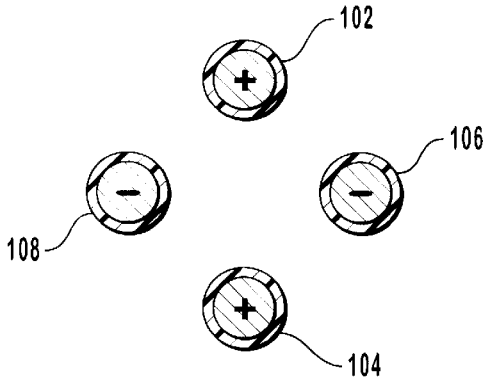
FIG. 2 is a cross-sectional view of the cable assembly for implementing a single channel, according to one embodiment of the present invention.

FIG. 2 depicts a cross-sectional view of the cable assembly of the present invention employed as a single channel assembly. FIG. 2 depicts the first pair of conductors comprised of first conductor 102 and second conductor 104 being electrically connected for transceiving the signals as presented at a positive terminal of an interface device. Likewise, the second pair of conductors, third conductor 106 and fourth conductor 108, are also electrically connected for parallelly transceiving the signal as presented at the neoative terminal of a particular interfacing device such as an audio amplifier or other communication terminal.

Figure 3:
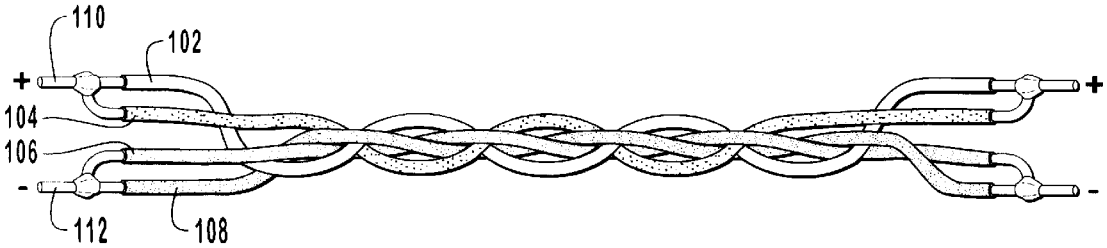
FIG. 3 is a perspective view of a single channel configuration of the cable, in accordance with one embodiment of the present invention.

FIG. 3 is a perspective view of the signal channel configuration of the cable assembly in accordance with one preferred embodiment of the present invention. FIG. 3 depicts the perspective view of the single channel implementation as depicted crosss-sectionally in FIG. 2. FIG. 3 depicts a positive terminal 110 being comprised of electrically combined or connected conductors 102 and 104 while the negative terminal 112 is comprised of electrically connected conductors 106 and 108.

Figure 4:
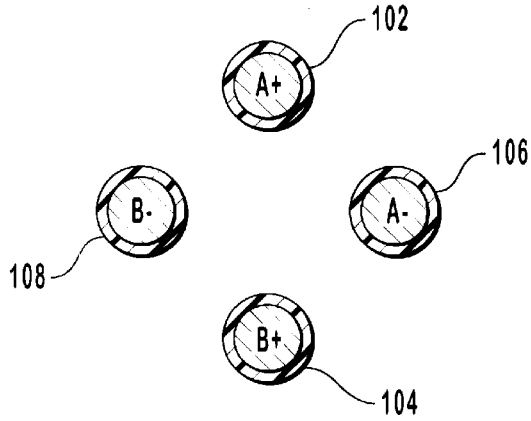
FIG. 4 is a cross-sectional view of the cable assembly for implementing a double or dual channel, according to one embodiment of the present invention.

FIG. 4 depicts a cross-sectional view of a cable assembly for implementing a double or dual channel configuration in accordance with another preferred embodiment of the present invention. The cross-sectional view depicts a first pair of conductors comprised of a first conductor 102 and a second conductor 104 which are functionally separated to be utilized in separate channels as are the second pair of conductors, conductor 106 and conductor 108. As shown in FIG. 4, the positive terminal for a channel A is implemented using first conductor 102 while the negative terminal for channel A is implemented using third conductor 106. Similarly, the positive terminal conductor for a channel B is implemented using second conductor 104 while the negative terminal connection for a channel B is implemented using fourth conductor 108.

Figure 5:
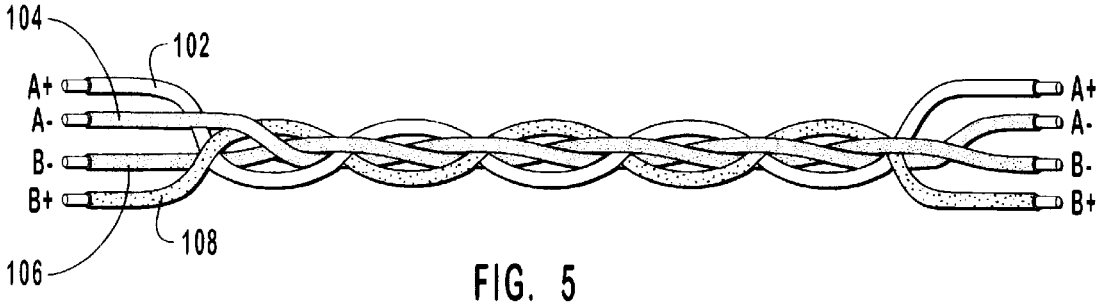
FIG. 5 is a perspective view of a double or dual channel configuration of the cable. in accordance with one embodiment of the present invention.

Similarly, with the single channel implementation of the above figures, the present dual channel implementation also benefits from the common mode rejection properties as well as the other phase, timing and line resistance qualities of the braided cable assembly of the present invention. FIG. 5 depicts the dual channel implementation of the braided cable assembly depicting a channel A comprised of conductors 102 and 104 and a channel B comprised of conductors 106 and 108.

A cable assembly has been presented which employs a braided four-wire orthogonal configuration that has inherently high common mode rejection due to the electrical and physical perpendicular configuration of the conductors. Such an arrangement ignores outside noise since the particular conductors are less sensitive to radiating E/H fields since a "ground plane" is woven into the cable assembly and therefore makes the cable a balanced system.

What is claimed and desired to be secured by United States Letters Patent is:

1. A cable assembly comprising:

a. a first pair of conductors comprised of a first conductor and a second conductor, said first conductor and said second conductor being twisted in a counter clockwise direction and forming generally first planar apertures between said first and second conductors with each half counter-clockwise turn of said first and second conductors, said generally first planar apertures being sized to receive therethrough a pair of conductors; and b. a second pair of conductors comprised of a third conductor and a fourth conductor, said third conductor and said fourth conductor being twisted in a clockwise direction and interwoven through said first planar apertures of said first pair of conductors, said third and fourth conductors forming generally second planar apertures between said third and forth conductors with each half clockwise turn of said third and fourth conductors, said first conductor and said second conductor being interwoven through said second planar apertures, said first planar apertures and said second planar apertures being substantially perpendicular.

2. The cable assembly as recited in claim 1, wherein said first pair of conductors are electrically combined for connecting between a first set of terminals and said second pair of conductors are electrically combined for connecting between a second set of terminals thereby forming a single channel cable assembly.

3. The cable assembly as recited in claim 1, wherein said first conductor of said first pair of conductors and said third conductor of said second pair of conductors for connecting between a first terminal and a second terminal, respectively for forming interconnections for a first channel, and second conductor of said first pair of conductors and said fourth conductor of said second pair of conductors for connecting between a third terminal and a fourth terminal respectively for forming interconnections for a second channel, said interconnections for said first channel and said second channel thereby forming a dual channel cable assembly.

4. A cable assembly for connecting positive and negative terminals of an audio amplifier with positive and negative inputs of an acoustic transducer, respectively, comprising:

a. a first pair of conductors comprised of a first conductor and a second conductor, said first conductor and said second conductor being twisted in a counter clockwise direction and forming generally first planar apertures between said first and second conductors with each half counter-clockwise turn of said first and second conductors, said generally first planar apertures being sized to receive therethrough a pair of conductors wherein said first pair of conductors are electrically combined for connecting between said positive terminal of said audio amplifier and said positive input of said acoustic transducer; and b. a second pair of conductors comprised of a third conductor and a fourth conductor, said third conductor and said fourth conductor being twisted in a clockwise direction and interwoven through said first planar apertures of said first pair of conductors, said third and fourth conductors forming generally second planar apertures between said third and fourth conductors with each half clockwise turn of said third and fourth conductors, said first conductor and said second conductor being interwoven through said second planar apertures, said first planar apertures and said second planar apertures being substantially perpendicular, wherein said second pair of conductors are electrically combined for connecting between said negative terminal of said audio amplifier and said negative input of said acoustic transducer.

5. A dual channel cable assembly for connecting positive and negative terminals of first and second channels of an audio amplifier with positive and negative inputs of first and second channels of an acoustic transducer, respectively, comprising:

a. a first pair of conductors comprised of a first conductor and a second conductor, said first conductor and said second conductor being twisted in a counter clockwise direction and forming generally first planar apertures between said first and second conductors with each half counter-clockwise turn of said first and second conductors, said generally first planar apertures being sized to receive therethrough a pair of conductors;

b. a second pair of conductors comprised of a third conductor and a fourth conductor, said third conductor and said fourth conductor being twisted in a clockwise direction and interwoven through said first planar apertures of said first pair of conductors, said third and fourth conductors forming generally second planar apertures between said third and fourth conductors with each half clockwise turn of said third and fourth conductors, said first conductor and said second conductor being interwoven through said second planar apertures, said first planar apertures and said second planar apertures being substantially perpendicular; and c. wherein said first conductor of said first pair of conductors and said third conductor of said second pair of conductors for connecting between said positive and negative terminals, respectively, and said positive and negative inputs of said first channel, said second conductor of said first pair of conductors and said fourth conductor of said second pair of conductors for connecting between said positive and negative terminals, respectively, of said second channel.

* * * * *

UNITED STATES PATENT AND TRADEMARK OFFICE

CERTIFICATE OF CORRECTION

PATENT NO. : 6,215,062 B1
DATED : April 10, 2001
INVENTOR(S) : Ray Latham Kimber It is certified that error appears in the above-identified patent and that said Letters Patent is hereby corrected as shown below:

Title page,
ABSTRACT, line 1, after "assembly having" delete "of"

Column 3,
Line 5, before "in accordance" change "cable." to -- cable, --

Column 4,
Line 14, after "at the" change "neoative" to -- negative --

Column 5,
Line 28, after "fourth" change "terminal" to -- terminal, --

Column 6,
Line 16, before "positive" insert -- the --
Lines 43-44, after "respectively," delete [and said positive and negative inputs]

Signed and Sealed this

Thirtieth Day of April, 2002

*Attest:*

*Attesting Officer*

JAMES E. ROGAN
*Director of the United States Patent and Trademark Office*

Disclaimer 6,215,062 — Ray Latham Kimber, 2752 S. 1900 West, Ogden, UT (US) 84401. MULTICONDUCTOR BRAIDED CABLE. Patent dated April 10, 2001. Disclaimer filed August 15, 2003, by the inventor.

Hereby enters this disclaimer to all claims of said patent.

*(Official Gazette, November 4, 2003)*